United States Patent [19]

Hradcovsky

[11] Patent Number: 5,069,763

[45] Date of Patent: Dec. 3, 1991

[54] METHOD OF COATING ALUMINUM WITH VANADIUM OXIDES

[76] Inventor: Rudolf Hradcovsky, 27 W. Beech St., Long Beach, N.Y. 11561

[21] Appl. No.: 459,552

[22] Filed: Jan. 2, 1990

[51] Int. Cl.[5] ..... C25D 11/02; C25D 11/06

[52] U.S. Cl. ..... 205/326; 205/322; 205/333

[58] Field of Search ..... 204/56.1, 58

[56] References Cited

U.S. PATENT DOCUMENTS

| | | | |
|---|---|---|---|
| 3,639,221 | 2/1972 | Dorsey, Jr. | 204/58 |
| 3,834,999 | 9/1974 | Hradcovsky et al. | 204/56.1 |
| 3,881,998 | 5/1975 | Miyosawa | 204/17 |
| 3,960,676 | 6/1976 | Miyosawa et al. | 204/38.3 |
| 4,082,626 | 4/1978 | Hradcovsky | 204/56.1 |
| 4,184,926 | 1/1980 | Kozak | 204/32.1 |
| 4,606,975 | 8/1986 | Mohr | 428/469 |
| 4,659,440 | 4/1987 | Hradcovsky | 204/58 |

FOREIGN PATENT DOCUMENTS

| | | | |
|---|---|---|---|
| 935713 | 10/1973 | Canada | 427/255.7 |

OTHER PUBLICATIONS

A. Kenneth Graham, Electroplating Engineering Handbook, second edition, Reinhold Publishing Corp., New York, 1962, p. 55.

*Primary Examiner*—John F. Niebling
*Assistant Examiner*—William T. Leader

[57] ABSTRACT

A method is provided for electrolytic coating of a rectifier metal with a hard, adherent, uniform and corrosion-resistant coating which predominates in vanadium oxides. A rectifier metal (anode) and a metal cathode are immersed in the electrolytic bath and voltage potential is applied across the two electrodes and raised to about 280 volts within about 25 to about 35 seconds, and thereafter raised further therefrom to between about 280 and about 360 volts within a few minutes until the desired coating thickness is obtained. The electrolytic bath comprises a mixture of a major amount of alkali metal orthovanadate and a minor amount of alkali metal silicate in water.

12 Claims, No Drawings

METHOD OF COATING ALUMINUM WITH VANADIUM OXIDES

FIELD OF THE INVENTION

This invention relates to an electrolytic method of coating rectifier metals, notably aluminum and its alloys, with vanadium oxides, and is particularly related to a method whereby the metal is coated with an adherent, hard, uniform and corrosion resistant layer of vanadium oxides. The invention also relates to an electrolytic bath for providing such coating on said metals and to the resulting coated articles.

BACKGROUND OF THE INVENTION

Aluminum and its alloys have been widely used in a variety of industrial and household applications in sheet forms or as strips, bars, rods, tubes, structural members, household appliances and utensils, hardware and a host of other articles. As mentioned in U.S. Pat. No. 2,941,930, there are numerous outlets for aluminum articles and its alloys for such uses as ornamental wall panels for inside or outside of various structures, restaurant furnishings, art objects and several other applications.

Because of its low density and tendency toward corrosion, it is necessary to provide aluminum articles with a suitable coating in order to impart structural strength and integrity thereto and to protect them against corrosion and environmental degradation. In the past, the metal surfaces were often painted or enameled in order to protect them against the action of the elements. However, painting and enameling do not provide the metal surfaces with satisfactory protection because they are basically organic coatings and tend to degrade at elevated temperatures. Moreover, these coatings usually adhere poorly to the metal surfaces, particularly when subjected to different temperature cycles.

In order to provide improved protection for aluminum and its alloys, the metal surfaces have been anodized using various electrolytic solutions. While anodization of aluminum affords the surface of the metal greater protection against corrosion than has hitherto been obtained by painting or enameling, still the resulting coated articles have not been entirely satisfactory because of inadequate resistance against corrosion by acids and alkalis. Moreover, the coatings imparted to the metal by known electrodeposition techniques often lack the desired degree of hardness, durability, smoothness, adherence to the metal surface and the imperviousness required to meet the ever-increasing industrial and household demands. Frequently, the coated aluminum articles have been unsatisfactory for use as decorative articles because of the poor quality or appearance of their surfaces.

There are numerous patents which deal with anodization of aluminum metal and its alloys. See, e.g., U.S. Pat. No. 4,659,440 and the patents cited therein. A review of the prior art patents illustrates the significant role of the electrolytic solution used in the anodizing process in order to provide aluminum and its alloys with the desired coatings. Thus, the nature and properties of the coatings formed on aluminum and its alloys depend, to a great extent, on the composition of the anodic bath (electrolytic solution). Other parameters such as the conditions used during the electrodeposition process also contribute to the nature and quality of the coating. These factors were recognized by the present inventor and discussed in his U.S. Pat. No. 4,082,626 and later in his aforementioned U.S. Pat. No. 4,659,440.

As described in said U.S. Pat. No. 4,082,626, a rectifier metal, (e.g., aluminum) is anodized in an electrolytic solution consisting of a relatively pure potassium silicate at concentrations exceeding the potassium silicate concentrations theretofore employed. The process comprised immersing the rectifier metal (anode) in the electrolytic solution, immersing a second metal in said solution, said second metal serving as the cathode, imposing a voltage potential across the anode and the cathode and causing an electric current to flow therebetween until a visible spark is discharged at the surface of the rectifier metal, increasing the voltage potential to about 300 volts and maintaining this potential at approximately the same level until the desired coating thickness is deposited on the surface of the rectifier metal. While the resulting coating exhibits more desirable qualities than the coatings obtained by the prior art anodizing methods, they still do not fulfill the stringent demands of various industrial and household requirements. In addition, the surface finish of the metal is not entirely satisfactory for decorative applications of the coated metallic article.

In his later U.S. Pat. No. 4,659,440, the present inventor describes the use of a different electrolytic solution for anodizing aluminum and its alloys. It consists essentially of an aqueous solution containing an alkali metal silicate, a peroxide, a water-soluble carboxylic group-containing organic acid and a water-soluble fluoride. Where the coated article is intended to be used for decorative purposes, a small amount of a vanadium compound is included in the electrolytic solution in order to impart color to the resulting coating. The vanadium compounds used to impart the desired color to the coatings include sodium vanadate ($Na_3VO_4$), hypovanadate $[M_2(CV_4O_9)].H_2O$, e.g., sodium pyrovanadate ($Na_2V_2O_7$) and potassium metavanadate ($KVO_3$), and vanadium fluorides such as vanadium trifluoride ($VF_3.H_2O$), vanadium tetrafluoride ($VF_3$) and vanadium pentafluoride ($VF_4$).

In the method described in the aforementioned U.S. Pat. No. 4,659,440, the aluminum article serving as the anode, and another metal serving as the cathode, are immersed in the electrolytic solution and a "voltage shock" is applied between these two electrodes. This voltage shock is quickly raised to about 300 volts within 2 to 10 seconds, and thereafter the voltage is raised gradually to about 450 volts within a few minutes until the desired coating thickness is formed. The coating produced in accordance with the method described in said patent is more uniform and homogeneous and less pervious than the coatings produced by the method described in the earlier U.S. Pat. No. 4,082,626. In the latter patent the aluminum surface is coated with a pure silicate compound, i.e., sodium silicate or potassium silicate, whereas in the former patent the coating also includes some vanadium compound.

OBJECTS OF THE INVENTION

It is an object of this invention to protect the surface of rectifier metals, particularly aluminum and its alloys, against corrosion and attack by the elements.

It is also an object of this invention to provide aluminum and its alloys with a hard, uniform, adherent, smooth, impervious and corrosion-resistant coating.

It is a further object of this invention to provide such metals with a protective coating of a vanadium compound.

It is yet a further object of this invention to protect the surfaces of aluminum and its alloys with a protective coating comprising a vanadium compound, notably vanadium oxides.

It is still an object of this invention to provide an electroylytic solution for coating aluminum and its alloys which solution is stable and can withstand the relatively high voltage potential applied during the electrodeposition method.

It is also an object of this invention to provide coated articles of aluminum or alloys of aluminum which are particularly well suited for various industrial, structural and household applications.

The foregoing and other objects and features of the present invention will be further described in, and more readily appreciated from the ensuing detailed description.

SUMMARY OF THE INVENTION

In accordance with the present invention, a rectifier metal (notably aluminum) is immersed in an electrolytic solution in which is also immersed another metal which is cathodic relative to the rectifier metal such as, e.g., iron. A voltage potential is imposed between the anodic metal and the cathodic metal thus causing a current to flow through the bath between said metals. This voltage potential is raised first to about 280 volts within 25 to 35 seconds and thereafter raised to about 280–360 volts within about 4 to about 6 minutes to obtain the desired coating thickness on the rectifier metal.

The electrolytic solution comprises a mixture, in water, of a major amount of an alkali metal orthovanadate such as sodium orthovanadate and potassium orthovanadate, a minor amount of an alkali metal silicate such as sodium silicate or potassium silicate, and may further include an alkali hydroxide, sodium peroxide or potassium peroxide to obtain a pH of about 12 to about 13.5.

The resulting coating on the rectifier metal is hard, uniform, durable and corrosion-resistant and is predominantly alkali metal orthovanadate.

DETAILED DESCRIPTION OF THE INVENTION

In accordance with this invention there is provided an electrolytic solution which, when used in the method of this invention to coat the surface of rectifier metals, imparts a uniform, hard, adherent and corrosion-resistant coating of vanadium oxides on the metal surfaces. This electrolytic solution is sometimes referred to as "electrolytic bath" or "anodic bath".

The method of this invention can be employed to coat those metals which in the electrolytic bath used herein exhibit rectifying quality. The term "rectifier metal" therefore, denotes such metals which include aluminum, tantalum, niobium and their alloys, and alloys of aluminum with zinc and copper. In case of aluminum alloys, the aluminum predominates in the alloy, and hence, the term "aluminum" as used throughout this application is intended to denote not only aluminum but its alloys as well.

A. The Electrolytic Bath: The principal and major component of the electrolytic bath used in the present invention is sodium orthovanadate ($Na_3VO_4$), potassium orthovanadate ($K_3VO_4$) or a mixture thereof. In forming the desired coating, however, it is not only necessary to employ such orthovanadate but it is equally significant to employ the orthovanadate as colloidal solution. For example, potassium orthovanadate may be prepared by dissolving vanadium pentaxide ($V_2O_5$) in aqueous solution of potassium hydroxide (KOH) at low temperatures of the order of about 25° to about 30°C. The resulting potassium orthovanadate solution is very weakly colloidal and not suitable for the present invention. In order to obtain a highly colloidal solution, the weakly colloidal potassium orthovanadate solution is "doped" with a very small amount of potassium silicate ($K_2SiO_3$) in a weight ratio of from about 0.1 to about 10.0 of potassium silicate to potassium orthovanadate at a pH of about 12. The resulting potassium orthovanadate is highly colloidal and well suited for use in the practice of the present invention.

The electrolytic bath may further include a minor amount of sodium peroxide ($Na_2O_2$), potassium peroxide ($K_2O_2$) or potassium hydroxide (KOH) and is usually maintained at a pH of about 12–13.5 during the electrolytic process.

B. The Electrolytic Method: In accordance with the method of this invention, the rectifier metal (aluminum) is immersed in a vessel containing the electrolytic solution maintained at a pH of about 12, and a second electrolytically-insoluble metal, such as iron or nickel, is also immersed in the electrolyte in the container. Thereafter, a voltage potential is applied across the electrodes and is raised to about 280 volts within about 25 to about 35 seconds to anodize the surface of the rectifier metal. This voltage is then further therefrom to between about 280 and about 360 volts within about 4 to about 6 minutes in order to obtain the desired coating of approximately 15 microns in thickness.

It is essential in the method of this invention that the alkali metal orthovanadate constitute the major component of the electrolytic bath not including water. Therefore, the amount of the alkali metal orthovanadate in the electrolyte solution is from about 5 to about 70 weight percent, and is preferably from about 25 to about 50 weight percent based on the total ingredients.

As was previously mentioned, a minor amount of alkali metal silicate (potassium silicate or sodium silicate) is added to the electrolytic bath to insure that the resulting orthovanadate is in highly colloidal solution. Thus, the amount of silicate is from about 0.1 to about 1.0 weight percent.

The electrolytic bath may also include small amounts of sodium peroxide, potassium peroxide or potassium hydroxide in order to adjust the pH within the desired level of about 12 to about 13.

The alkali metal silicate used in preparing the electrolytic solution is used in a concentration ranging from about 1° to about 5° Baume and is preferably used in a concentration ranging from about 1.5° to about 2° Baume. The other ingredients, i.e., sodium peroxide, potassium peroxide and potassium hydroxide are used in granular form.

The following examples illustrate the use of electrolytic solution containing different concentrations of alkali metal orthovanadate for coating aluminum by the method of this invention. These examples, however, are only illustrative and are not to be construed so as to limit the scope of the present invention.

EXAMPLE 1

An electrolytic bath was prepared by first mixing 65 grams of 5° Baume sodium orthovanadate, 3 grams of 30° Baume potassium silicate and 1 gram of sodium peroxide in 500 cc water to form a highly colloidal solution. An additional 23 grams of sodium orthovanadate was added to this colloidal solution so that the resulting coating will have an acceptable black color tone. The resulting electrolytic bath had a pH of 12. An aluminum sheet (50×50×1 mm) was immersed in the electrolytic bath in a container and an iron sheet was also immersed in the same container. The bath was maintained at 25° C. A voltage potential was applied across the two electrodes and was raised to 280 volts within 30 seconds in order to anodize the rectifier metal surface. Thereafter, the voltage potential was raised to approximately 360 volts the next five minutes to obtain the desired coating. The resulting coating was black, approximately 15 microns in thickness and predominating in vanadium oxides ($V_2O_3$, $V_2O_4$ and $VO_2$). It was uniform, hard and highly adherent to the rectifier metal surface. The coated aluminum sheet exhibited excellent corrosion resistance.

EXAMPLES 2-6

The same procedure as in Example 1 was followed except for changes in the ingredients and/or their quantities. In all cases the resulting coating was black, hard, uniform and adhered well to the aluminum surface and the resulting coated article had excellent corrosion resistance. The components of the electrolytic solutions and their amounts were as follows:

EXAMPLE 2

25 grams $Na_3VO_4$
4 grams $K_2SiO_3$
2 grams $Na_2O_2$
500 cc water
Additional 50 grams $Na_3VO_4$

EXAMPLE 3

23 grams $Na_3VO_4$
2 grams $K_2Si_3$
3 grams KOH
500 cc water
Additional 40 grams $Na_3VO_4$

EXAMPLE 4

15 grams $K_3VO_4$
4 grams $K_2SiO_3$
2 grams KOH
500 cc water
Additional 30 grams $K_3VO_4$

EXAMPLE 5

10 grams $K_3VO_4$
3 grams $K_2SiO_3$
3 grams KOH
500 cc water
Additional 40 grams $K_3VO_4$

EXAMPLE 6

5 grams $K_3VO_4$
3 grams $K_2SiO_3$
2 grams KOH
500 cc water
Additional 60 grams $K_3VO_4$
pH 12

The resulting coatings in Examples 1-5 had a black tone whereas the coating obtained in Example 6 was dark brown. The difference in tone is basically attributed to the relative amounts of vanadates and silicates and to a degree on the pH of the electrolytic bath.

Aluminum and aluminum alloys coated with vanadium oxides by the electrolytic method of this invention find widespread utility in such fields where anti-corrosivity is required. For example, they may be used as structural materials, for fabricating reaction vessels, fluid pipes and like handling corrosive materials and for numerous other parts and equipments.

While the invention has been described with a certain degree of particularity, it must be understood that several obvious changes and modifications can be made both in the electrolytic bath as well as the coating method. Such changes and modifications are nevertheless within the scope of the present invention.

What is claimed is:

1. A method of coating a rectifier metal selected from the group consisting of aluminum, tantalum, niobium, and alloys thereof, and alloys of aluminum with copper or zinc, to produce hard, uniform, adherent and corrosion-resistant layer predominating in vanadium oxides, said method comprising:

(a) immersing said rectifier metal in an aqueous electrolytic bath comprising a major amount of alkali metal orthovanadate and a minor amount of alkali metal silicate, exclusive of water, (b) immersing another metal which is cathodic with respect to said rectifier metal in said electrolytic bath when a voltage potential is applied between said metals, and (c) imposing a voltage potential between said rectifier metal and said cathodic metal and raising said voltage potential to about 280 volts within about 25 to about 35 seconds, and thereafter raising said voltage potential further therefrom to between about 280 to about 360 volts until the desired coating thickness is deposited on the rectifier metal.

2. A method as in claim 1 wherein said rectifier metal is aluminum or aluminum alloy.

3. A method as in claim 2 wherein said cathodic metal is iron or nickel.

4. A method as in claim 3 wherein said electrolytic bath further comprises alkali metal hydroxide or alkali metal peroxide, and wherein the pH of the electrolytic bath is from about 12 to about 13.5.

5. A method as in claim 2 wherein said electrolytic bath further comprises alkali metal hydroxide or alkali metal peroxide, and wherein the pH of the electrolytic bath is from about 12 to about 13.5.

6. A method as in claim 1 wherein said rectifier metal is aluminum.

7. A method as in claim 6 wherein said cathodic metal is iron or nickel.

8. A method as in claim 7 wherein said electrolytic bath further comprises alkali metal hydroxide or alkali metal peroxide, and wherein the pH of the electrolytic bath is from about 12 to about 13.5.

9. A method as in claim 6 wherein said electrolytic bath further comprises alkali metal hydroxide or alkali metal peroxide, and wherein the pH of the electrolytic bath is from about 12 to about 13.5.

10. A method as in claim 1 wherein said cathodic metal is iron or nickel.

11. A method as in claim 10 wherein said electrolytic bath further comprises alkali metal hydroxide or alkali metal peroxide, and wherein the pH of the electrolytic bath is from about 12 to about 13.5.

12. A method as in claim 1 wherein said electrolytic bath further comprises alkali metal hydroxide or alkali metal peroxide, and wherein the pH of the electrolytic bath is from about 12 to about 13.5.

* * * * *